US005787571A

United States Patent [19]

Hatakenaka

[11] Patent Number: 5,787,571

[45] Date of Patent: Aug. 4, 1998

[54] METHOD OF PRODUCING COIL DEVICES

[75] Inventor: Tetsuo Hatakenaka, Takefu, Japan

[73] Assignee: Murata Manufacturing Co., Ltd., Nagaokakyo, Japan

[21] Appl. No.: 781,715

[22] Filed: Jan. 10, 1997

[30] Foreign Application Priority Data

Jan. 11, 1996 [JP] Japan ..... 8-002743

[51] Int. Cl.[6] ..... H01F 41/06

[52] U.S. Cl. ..... 29/605; 29/608; 336/192

[58] Field of Search ..... 29/605, 608, 602.1; 336/192, 233

[56] References Cited

U.S. PATENT DOCUMENTS 3,008,108 11/1961 Baker et al. ..... 29/605
5,457,872 10/1995 Sakata et al. ..... 29/605

FOREIGN PATENT DOCUMENTS 57-048216 3/1992 Japan .

*Primary Examiner*—Carl E. Hall
*Attorney, Agent, or Firm*—Burns, Doane, Swecker & Mathis, LLP

[57] ABSTRACT

A method for accurately and inexpensively producing a chip-type coil device comprises first forming an insulating plate. A plurality of parallel division grooves are then formed in a first direction on the insulating plate on one surface thereof. Thereafter, a conductive layer is formed on the insulating plate, wherein the conductive layer also coats the division grooves. The process then entails forming recess grooves between the division grooves on the insulating plate on which the conductive layer has been formed, and then dividing the insulating plate by forming slots within the division grooves, wherein the slots have widths which are smaller than widths of the division grooves. The method then entails dividing the insulating plate in a second direction to form a plurality of cores, wherein each of the cores comprise at least two leg portions having a first recess therebetween formed by one of the first recess grooves, and further including terminal electrodes on the leg portions formed by the conductive layer. Thereafter, for each of the cores, winding wire is wound around a winding section of the core and the wire is connected to terminal electrodes on the leg portions. The method provides devices which have improved accuracy and strength compared to the conventional devices produced by press molding.

12 Claims, 3 Drawing Sheets

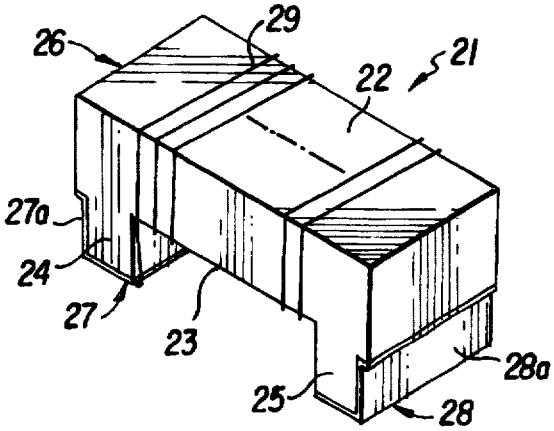
FIG. 1
FIG. 2
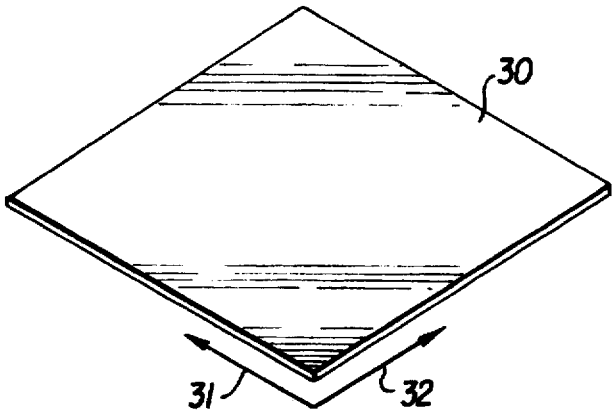
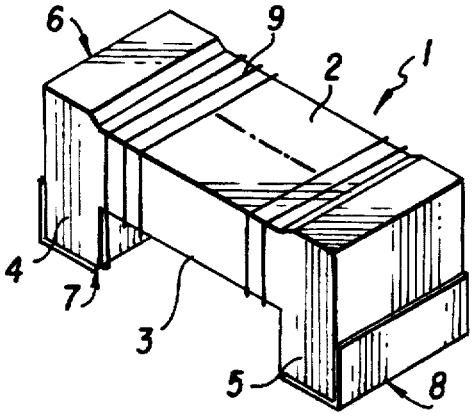
FIG. 8
(PRIOR ART)
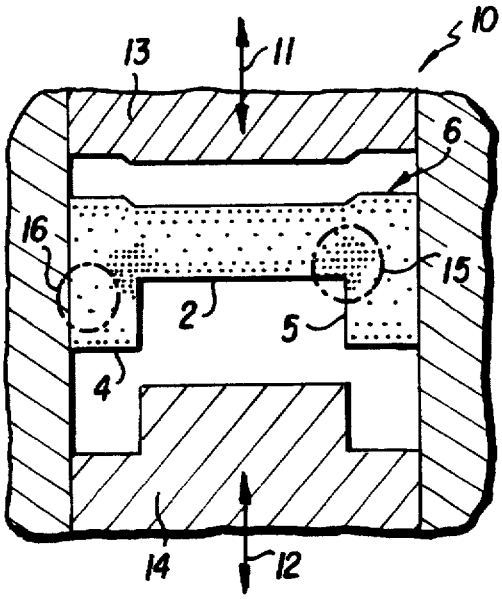
FIG. 9
(PRIOR ART)

FIG. 3(1)
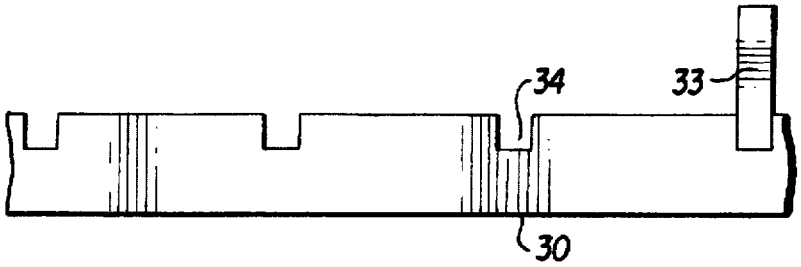
FIG. 3(2)
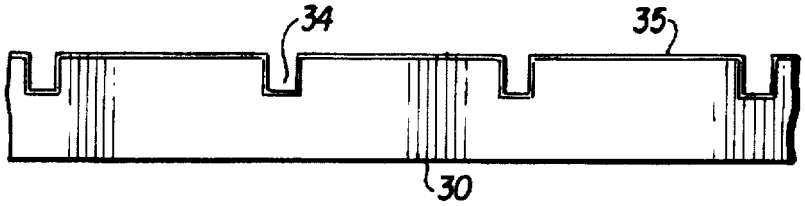
FIG. 3(3)
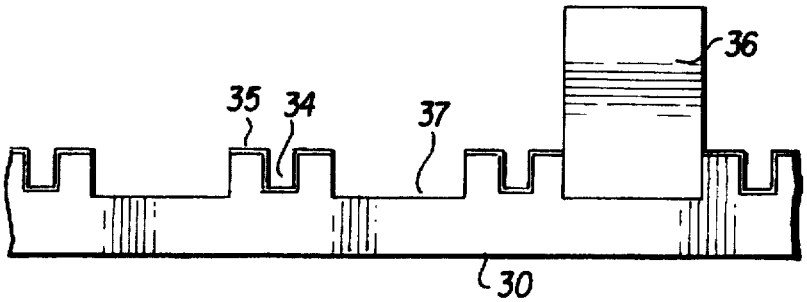
FIG. 3(4)
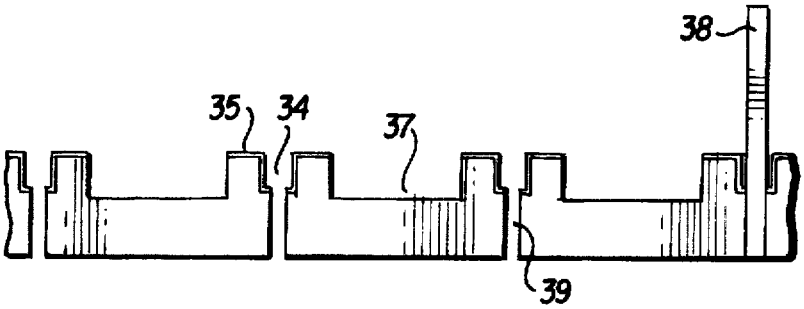
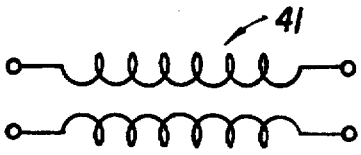
FIG. 5
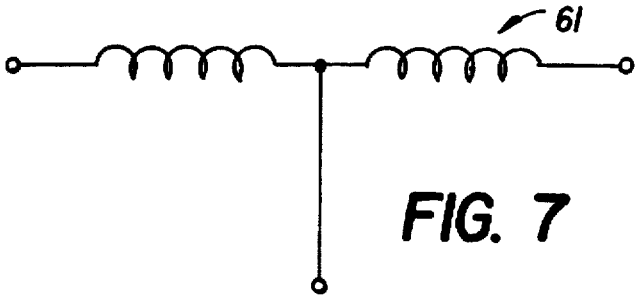
FIG. 7

METHOD OF PRODUCING COIL DEVICES

BACKGROUND OF THE INVENTION

1. Field of the Invention

The present invention relates to a method for producing a chip-type coil device and, in particular, to a method for producing a wire-wound chip-type coil device in which a wire is wound around a core of the coil device. The invention also relates to a chip-type coil device produced by this method.

2. Description of the Related Art

FIG. 8 is a perspective view of a conventional chiptype coil device 1. This chip-type coil device 1 can be used, for example, to provide a high-frequency coil.

The chip-type coil device 1 shown in FIG. 8 includes a core 6. The core 6 has a winding section 2 and leg portions 4 and 5 protruding from end portions of the winding section 2. The gap between the leg portions 4 and 5 defines a recess 3. Terminal electrodes 7 and 8 are formed at the ends of the leg portions 4 and 5, respectively. A wire 9 is wound around the winding section 2, and the ends of the wire 9 are electrically connected to the terminal electrodes 7 and 8 by soldering or the like.

The above-described chip-type coil device 1 is produced by first forming the core 6. The core 6 is produced by loading a ferrite powder material, an alumina powder material, a dielectric powder material or the like into a press forming machine 10, as shown in FIG. 9, and thereafter firing the material. The press forming machine 10 is equipped with dies 13 and 14 which operate in the directions of arrows 11 and 12 to exert a pressing force on the material disposed therebetween.

After forming the core 6 in this manner, the terminal electrodes 7 and 8 are formed on the end portions of the leg portions 4 and 5 of the core 6. The terminal electrodes are formed by plating, printing or the like, in combination with a masking operation. Next, the wire 9 is wound around the winding section 2 of the core 6, and the ends of this wire 9 are connected to the terminal electrodes 7 and 8, thereby completing the chip-type coil device 1.

However, the above-described method of producing the chip-type coil 1 device has a number of disadvantages. First, to reduce the size of the chip-type coil device 1, it is necessary to reduce the size of the core 6. As the size of the core 6 is reduced, the press forming machine 10, including dies 13 and 14, must exercise a higher level of precision in its performance. This makes it more difficult to control the powder material charging amount and the press pressure in the press forming machine 10. This, in turn, places substantial limitations on the extent to which this type of machine can be improved. Further, this technique is not suitable for mass production, which increases the cost of manufacturing the chip-type coil devices.

Moreover, in terms of performance, press forming the core 6 as shown in FIG. 9 tends to cause an imbalance in density in the core 6. Note FIG. 9, for instance, which shows the density of the core 6 after press forming, as represented by the density of dots. For example, the density in portion 15 is relatively high and, in portion 16, it is relatively low. As a result, after firing, the dimensional accuracy of the core 6 is rather poor. Further, this imbalance in density produces a variation in the strength of the core 6.

Further, as the size of the core 6 is reduced, the terminal electrodes 7 and 8 become smaller, making it more difficult to form these terminal electrodes 7 and 8 with high dimensional accuracy. In the case of a high-frequency coil device, the variation in the value of capacitance (stray capacitance) due to the variation in the dimensions of the terminal electrodes 7 and 8 considerably affects the high-frequency characteristics of the device, so that a high level of dimensional accuracy is required for the terminal electrodes 7 and 8.

SUMMARY OF THE INVENTION

It is accordingly an object of this invention to provide a method for producing chip-type coil devices which solves at least the above-identified problems of the prior art.

According to exemplary embodiments, the invention provides a method for the production of a chip-type coil device of the type which has a core including a winding section and leg portions protruding from end portions of the winding section. A recess is formed between the leg portions, and terminal electrodes are formed at the ends of the leg portions. Furthermore, wire is wound around the winding section and electrically connected to the terminal electrodes. Such a device can be produced according to the following method.

First, an insulating plate is prepared. A conductive layer is then formed on one surface of this insulating plate. Then, on the surface on which the conductive layer has been formed, recess grooves are formed. The insulating plate is then divided, thereby producing a plurality of cores. Each core includes a recess formed by a recess groove, and includes terminal electrodes formed by the conductive layer. A wire is wound around the winding section of each core and electrically connected to the terminal electrodes.

In accordance with this invention, the core can be produced by performing cutting operations on the insulating plate, thereby eliminating the need for press forming and the consequent density imbalances produced thereby. As a result, the method of the present invention produces devices with improved dimensional accuracy and strength.

Further, since a series of operations are performed on the insulating plate rather than the individual cores, it is possible to efficiently produce a large number of cores, which is advantageous from the viewpoint of mass production.

Further, when forming a recess groove comprising the recess between the leg portions of the core, it is easy to change the depth of the recess groove. When the depth of the recess is varied (that is, the distance between the end of the leg portions and the winding section) the sectional area of the winding portion of the core is likewise varied, thereby making it easy to adjust the inductance of the device. Further, the method can produce a wide variety of device structures by changing the width of the recess groove, the position where the recess groove is formed, the position where the insulating plate is divided, the number of locations where the recess groove is formed (to change the number of recesses in a core obtained through division), etc. Thus, as compared to the conventional technique in which the core is obtained by press forming using dies, such design change can be implemented more easily, inexpensively and quickly.

According to exemplary embodiments of this invention, division grooves are formed in the insulating plate before the conductive layer is formed. When the conductive layer is formed, it coats the divisions grooves, including the inner surfaces of the division grooves. The step of dividing includes dividing the insulating plate by forming slots having a width smaller than that of the division grooves. As a result, the terminal electrodes include a conductive layer which extends on the end surfaces of the leg portions as well as the side surfaces adjacent to the end surfaces. When the terminal electrodes thus possess adjacent-surface extension portions, it is easier to mount the chip-type coil device on a circuit board by soldering, thereby improving the reliability of soldering.

Further, when the adjacent-surface extension portions of the terminal electrodes are thus formed, it is possible to correctly determine the dimension of the adjacent surface-extension portions according to the depth of the division grooves. Since this adjacent surface extension portion is a region where the magnetic field of the coil passes, a change in its dimension greatly effects the coil characteristics. However, when, as described above, the adjacent-surface extension portions can be accurately formed, the variation in the coil characteristics can be reduced. In particular, it is possible to enhance the Q-characteristics of the device, which is an important factor in the design of a high-frequency coil device. By varying the depth of the division grooves, the designer can easily change the dimension of the adjacent-surface extension portions, thereby facilitating adjustment in the characteristics of the device.

BRIEF DESCRIPTION OF THE DRAWINGS

FIG. 1 is a perspective view of a chip-type coil device 21 produced according to one exemplary method of the invention;

FIG. 2 is a perspective view of an insulating plate 30 for producing the chip-type coil device 21 shown in FIG. 1;

FIGS. 3(1) through 3(4) are sectional views illustrating the sequence of procedures performed on the insulating plate 30 shown in FIG. 2 to obtain the device shown in FIG. 1;

FIGS. 4A through 4C illustrate a chip-type coil device 41 produced according to another exemplary embodiment of the present invention, wherein FIG. 4A is a front view of the device, FIG. 4B is a bottom view of the device, and FIG. 4C is a right-side view of the device;

FIG. 5 is an equivalent circuit diagram of a chiptype coil device 41 shown in FIGS. 4A through 4C;

FIGS. 6A through 6C illustrate a chip-type coil device 61 produced according to another embodiment of the present invention, wherein FIG. 6A is a front view of the device, FIG. 6B is a bottom view of the device, and FIG. 6C is a right-side view of the device;

FIG. 7 is an equivalent circuit diagram of a chip-type coil device 61 shown in FIGS. 6A through 6C;

FIG. 8 is a perspective view of a conventional chip-type coil device 1; and FIG. 9 is a sectional view illustrating a press forming process conventionally executed for producing the core 6 shown in FIG. 8.

DESCRIPTION OF THE PREFERRED EMBODIMENTS

Figure 4A:
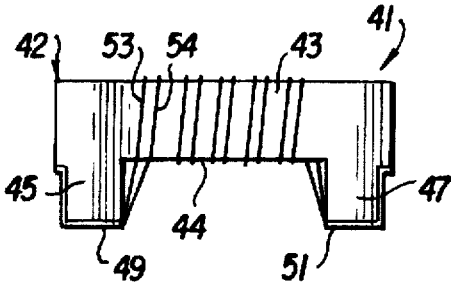

FIG. 1 is a perspective view of a chip-type coil device 21 producing according to one exemplary embodiment of the present invention.

This chip-type coil device is used, like the chip-type coil device 1 shown in FIG. 8., as a high-frequency coil device or the like. It includes a core 26 having a wiring section 22 and leg portions 24 and 25 respectively protruding from the ends of the wiring section 22. A recess 23 is located between the leg portions 24 and 25. Terminal electrodes 27 and 28 are formed at the ends of the leg portions 24 and 25. A wire 29 is wound around the wiring section 22, and the end portions of the wire 29 are electrically connected to the terminal electrodes 27 and 28, respectively, by soldering, welding or the like.

To produce this chip-type coil device 21, a core 26 is first formed. To obtain this core 26, an insulating plate 30 as shown in FIG. 2 is first prepared. The insulating plate 30 is formed, for example, of a dielectric porcelain, alumina porcelain, ferrite porcelain, synthetic resin or the like. Its dimensions are such that when it is divided along parallel lines in the direction of arrows 31 and 32, a plurality of cores 26 can be obtained.

FIGS. 3(1) through 3(4) show a series of steps which are sequentially performed on the insulating plate 30. First, as shown in FIG. 3(1), by using, for example, a dicing blade 33, a plurality of division grooves 34 are formed on one surface of the insulating plate 30. In one embodiment, these division grooves 34 extend parallel to each other and at equal intervals in the direction of the arrow 31 of FIG. 2.

Next, as shown in FIG. 3(2), a conductive layer 35 is formed on one surface of the insulating plate 30. The conductive layer 35, which comprises the terminal electrodes 27 and 28, is formed by, for example, dry plating (e.g. sputtering). The conductive layer 35 can also be formed by printing, wet plating, or other technique. The conductive layer 35 is also formed on the inner surfaces of the division grooves 34.

Next, as shown in FIG. 3(3), a plurality of recess grooves 37 are formed on one surface of the insulating plate 30, on which the conductive layer 35 has been formed, by using, for example, a dicing blade 36. Each of these recess grooves 37, which comprise the recess 23 between the leg portions 24 and 25 shown in FIG. 1, is situated between adjacent division grooves 34 formed in the manner described above. The formation of these recess grooves 37 separates the conductive layer 35.

Next, as shown in FIG. 3(4), slots 39 are formed in the insulating plate 30 by applying, for example, a dicing blade 38 along the division grooves 34, thereby dividing the insulating plate 30. The size of this dicing blade 38 is such that the slots 39 thereby formed have a width smaller than the width of the division grooves 34. Thus, the conductive layer 35 formed on the inner side surfaces of the division grooves 34 remains intact after the formation of the slots 39.

Next, when the insulating plate 30 is further divided along lines in the direction of the arrow 32 of FIG. 2, a plurality of independent cores 26, as shown in FIG. 1, are obtained. This division along lines in the direction of the arrow 32 can be conducted at different stages. For example, it may be conducted prior to the process of FIG. 3(4) or prior to the process of FIG. 3(3).

As shown in FIG. 1, each of the cores 26 thus obtained has a winding section 22 and leg portions 24 and 25 protruding from the ends of the winding section 22. Further, terminal electrodes 27 and 28 are formed on the end portions of the leg portions 24 and 25. These terminal electrodes 27 and 28 are formed on the end surfaces of the leg portions 24 and 25, as well as the adjacent surface extensions **27*a* and 28*a*, which are formed on the side surfaces adjacent to the end surfaces. The adjacent surface extensions 27*a* and 28*a* are recessed from the side surfaces of the winding section 22**.

After forming the core 26, as in the case of the chip-type coil device 1 of FIG. 8 described above, a wire 29 is wound around the winding section 22 of the core 26, as shown in FIG. 1, and the end portions of this wire 29 are connected to the terminal electrodes 27 and 28, to provide the completed chip-type coil device 21 of FIG. 1.

According to exemplary aspects of the above-described embodiment, the depth of the recess grooves 37 formed by the dicing blade 36 shown in FIG. 3(3) can be easily changed. The inductance of the chip-type coil device 21 is a function of the depth of the recess groove 37. Thus, the manufacturer can easily adjust the inductance of the device 21 by altering the depth of the groove 37.

Further, the manufacturer can easily change the depth of the division grooves 34 formed by the dicing blade 33 shown in FIG. 3(1). By varying the depth of the division grooves 34, the height of the adjacent surface extensions 27*a* and 28*a* of the terminal electrodes can be easily and accurately changed. In the chip-type coil device 21, these adjacent surface extensions 27*a* and 28*a* are located in regions where the magnetic field passes, so that the dimensions of the adjacent surface extensions 27*a* and 28*a* have a great influence on the characteristics of the chip-type coil device 21. Thus, changing of the dimensions of the adjacent surface extensions 27*a* and 28*a* can be used to adjust the characteristics of the chip-type coil device 21. Furthermore, since the dimensions of the adjacent surface extensions 27*a* and 28*a* can be accurately determined by the depth of the division grooves 34, it is possible to reduce the variation in the characteristics of the chip-type coil device 21.

In another embodiment, the process shown in FIG. 3(1) is not performed, so that the division grooves 34 are not formed. In other words, the process comprises the procedure set forth in FIG. 3(2) through FIG. 3(4). This provides cores on which terminal electrodes are formed, but in this case, the terminal electrodes have no adjacent surface extensions corresponding to the adjacent surface extensions 27*a* and 28*a* of the terminal electrodes 27 and 28 shown in FIG. 1.

Further, other embodiments entail changing the position of the division grooves 34 and the width of the recess grooves 37. More generally, using the method discussed above, it is possible to produce chip-type coil devices having different types of structures than the device 21 of FIG. 1. Some examples of different chip-type coil device structures that can be obtained are described below.

Figure 4B:
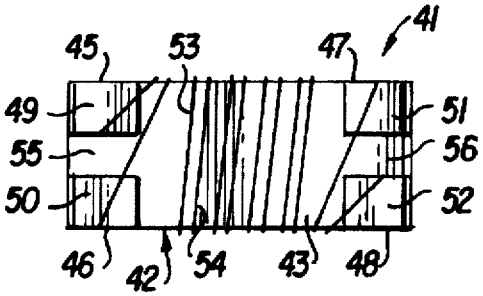
Figure 4C:
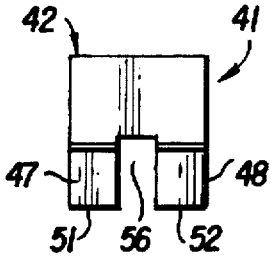

FIGS. 4A through 4C illustrate a chip-type coil device 41 obtained by a production method according to another exemplary embodiment of the present invention. More specifically, FIG. 4A shows a front view of the device 41, FIG. 4B is a bottom view of the device 41, and FIG. 4C is a right-side view of the device 41. FIG. 5 is an equivalent circuit diagram of the chip-type coil device 41 shown in FIGS. 4A through 4C.

As shown in FIGS. 4A through 4C, the chip type-coil 41 has a core 42 including a winding section 43 and four leg portions 45, 46, 47 and 48 protruding from the end portions of the winding section 43 so as to define a recess 44 between the leg portions. Terminal electrodes 49, 50, 51 and 52 are formed at the ends of the leg portions 45, 46, 47 and 48, respectively.

Two wires 53 and 54 are wound around the winding section 43. The end portions of one wire 53 are respectively connected to the terminal electrodes 49 and 51, and the end portions of the other wire 54 are respectively connected to the terminal electrodes 50 and 52. Thus, as shown in FIG. 5, this chip-type coil device 41 comprises a coil having four terminals.

In the core 42 of this chip-type coil device 41, recesses 55 and 56 are respectively formed between the leg portions 45 and 46 and the leg portions 47 and 48. Thus, to obtain this core 42, a process for forming these recesses 55 and 56 is added to the process shown in FIG. 3 at some stage in that process by cutting an additional series of grooves.

Further, the number of terminal electrodes can be changed to provide more terminals or fewer terminals. For example, 6 or 8 terminals can be provided, thereby allowing the construction of a coil having three or four elements.

Figure 6A:
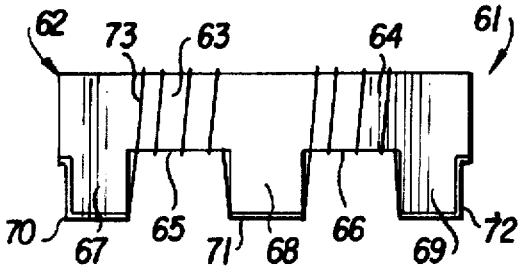
Figure 6B:
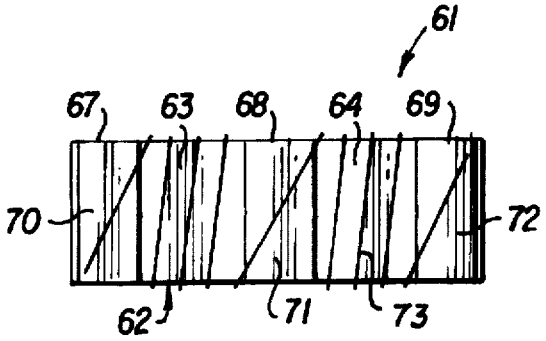
Figure 6C:
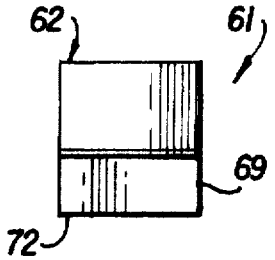

FIGS. 6A through 6C illustrate a chip-type coil device 61 obtained by a production method according to still another embodiment of the present invention. More specifically, FIG. 6A is a front view of the device 61, FIG. 6B is a bottom view of the device 61, and FIG. 6C is a right-side view of the device 61. FIG. 7 is an equivalent circuit diagram of a chip-type coil device 61 shown in FIGS. 6A through 6C.

As shown in FIGS. 6A through 6C, this chip-type coil device 61 includes a core 62 having two winding sections 63 and 64 arranged in series. Three leg portions 67, 68 and 69 protrude from the end portions of these winding sections 63 and 64, which define recesses 65 and 66 between the leg portions. Further, terminal electrodes 70, 71 and 72 are respectively formed at the ends of the leg portions 67, 68 and 69.

A wire 73 is sequentially wound around the winding sections 63 and 64, and connected to the terminal electrodes 70, 71 and 72. Thus, as shown in FIG. 7, this chip-type coil device 61 is constructed as a T-type filter including three terminals.

Two recesses 65 and 66 are formed in the core 62 of this chip-type coil device 61. Thus, to obtain this core 62, the process shown in FIG. 3 is modified to form recesses 65 and 66 instead of recess grooves 37 (as shown in FIG. 3(3).

Those skilled in the art will readily appreciate that other types of structures can be obtained using the principles taught herein. Generally, forming recesses by cutting grooves in a plate allows a manufacturer to produce devices having improved dimensional accuracy and strength, and thereby allows the manufacturer to produce smaller devices than possible using the conventional technique of press molding.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A method of producing coil devices, comprising the steps of:

forming an insulating plate;

forming a plurality of parallel division grooves in a first direction on said insulating plate on one surface thereof;

forming a conductive layer on said insulating plate on said one surface thereof, wherein said conductive layer is also formed in said division grooves;

forming a plurality of first recess grooves between said division grooves on said insulating plate on which said conductive layer has been formed;

dividing said insulating plate by forming slots within said division grooves, wherein said slots have widths which are smaller than widths of said division grooves;

dividing said insulating plate in a second direction to form a plurality of cores, wherein each of said cores comprise at least two leg portions having a first recess therebetween formed by one of said first recess grooves, and further including terminal electrodes on said leg portions formed by said conductive layer; and for each of said cores, winding wire around a winding section of said core and electrically connecting said terminal electrodes on said leg portions to said wire.

2. The method of claim 1, wherein said step of dividing said insulating plate by forming slots within said division grooves produces terminal electrodes having L-shaped cross sections.

3. The method of claim 1, wherein said steps for forming said division grooves, recess grooves, and slots employ one or more cutting devices to cut said insulating plate.

4. The method of claim 3, wherein said one or more cutting devices comprise one or more dicing blades.

5. The method of claim 1, wherein said step of dividing said insulating plate in a second direction precedes said step of dividing said insulating plate by forming slots.

6. The method of claim 1, wherein said step of dividing said insulating plate in a second direction precedes said step of forming recess grooves.

7. The method of claim 1, further comprising the step of forming a plurality of second recess grooves.

8. The method of claim 7, wherein said steps of forming said first and second recess grooves comprise forming said first plurality of recess grooves in said first direction and said second plurality of recess grooves in said second direction, such that each of said cores formed by said method comprise at least four leg portions having terminal electrodes disposed thereon.

9. The method of claim 8, wherein, for each of said cores, said at least four leg portions comprise a first pair of legs and a second pair of legs, and wherein said winding step further comprises the step of winding a first and a second wire around each core, and connecting ends of said first wire to terminal electrodes of said first pair of legs, and connecting ends of said second wire to terminal electrodes of said second pair of legs.

10. The method of claim 7, wherein said steps of forming said first and second recess grooves comprise forming said first plurality of recess grooves in said first direction and said second plurality of recess grooves also in said first direction, such that each of said cores formed thereby comprise at least three leg portions having terminal electrodes disposed thereon.

11. The method of claim 10, wherein said step of winding comprises, for each of said cores, winding a wire around portions of said core between a first and second leg portions, and around portions of said core between said second and a third leg portions.

12. The method of claim 1, wherein said step of dividing said insulating plate in a second direction precedes said step of forming recess grooves.

* * * * *

UNITED STATES PATENT AND TRADEMARK OFFICE

CERTIFICATE OF CORRECTION

PATENT NO. : 5,787,571

DATED : August 4, 1998

INVENTOR(S) : Tetsuo Hatakenaka

It is certified that error appears in the above-indentified patent and that said Letters Patent is hereby corrected as shown below:

On the title page, item [56], please add references:

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION | |
|---|---|---|---|---|---|---|---|---|---|---|---|---|---|---|
| | | | | | | | | | | | | | YES | NO |
| | | 0 | 7 | 2 | 4 | 5 | 2 2 8 | A | 09/95 | Japan(abstract only) | | | | |
| | | DE | 36 | 15 | 37 | C2 | | | 04/94 | Germany | | | | |
| | | EP | 7 | 12 | 142 | A2 | | | 05/96 | EPO | | | | |
| | | | | | | | | | | | | | | |
| | | | | | | | | | | | | | | |
| | | | | | | | | | | | | | | |
| | | | | | | | | | | | | | | |
| | | | | | | | | | | | | | | |

Signed and Sealed this

Fifth Day of October, 1999

*Attest:*

*Attesting Officer*

Q. TODD DICKINSON

*Acting Commissioner of Patents and Trademarks*